US009874040B1

(12) United States Patent
Smith

(10) Patent No.: US 9,874,040 B1
(45) Date of Patent: Jan. 23, 2018

(54) HITCH-MOUNTED WIRE UNROLLER APPARATUS

(71) Applicant: Charles Smith, Pine Knot, KY (US)

(72) Inventor: Charles Smith, Pine Knot, KY (US)

( * ) Notice: Subject to any disclaimer, the term of this patent is extended or adjusted under 35 U.S.C. 154(b) by 39 days.

(21) Appl. No.: 14/805,519

(22) Filed: Jul. 22, 2015

(51) Int. Cl.
*B65H 49/32* (2006.01)
*E04H 17/26* (2006.01)
*B60R 9/06* (2006.01)

(52) U.S. Cl.
CPC ..... *E04H 17/266* (2013.01); *B60R 9/06* (2013.01); *B65H 49/32* (2013.01)

(58) Field of Classification Search
CPC ..... E04H 17/266; B60R 9/06; B65H 49/32
See application file for complete search history.

(56) References Cited

U.S. PATENT DOCUMENTS

| | | | | |
|---|---|---|---|---|
| 2,416,585 | A | 2/1947 | Holub | |
| 4,339,096 | A | 7/1982 | May | |
| 4,397,607 | A | 8/1983 | Neill, Jr. et al. | |
| 4,806,063 | A | 2/1989 | York | |
| 4,946,113 | A | 8/1990 | Riffle et al. | |
| 5,568,900 | A | 10/1996 | Conroy | |
| 5,582,216 | A * | 12/1996 | Smith | E04H 17/266 140/107 |
| 6,568,624 | B2 | 5/2003 | Jackson | |
| 7,264,195 | B2 | 9/2007 | Fletcher et al. | |
| 7,530,523 | B1 | 5/2009 | Murray | |
| 8,702,029 | B1 | 4/2014 | Thompson | |
| 2004/0065767 | A1 | 4/2004 | Parker | |
| 2006/0266877 | A1 | 11/2006 | Feather | |
| 2010/0044999 | A1 * | 2/2010 | Columbia | A01K 97/10 280/511 |
| 2010/0090053 | A1 | 4/2010 | Stiltner | |
| 2014/0028046 | A1 | 1/2014 | Cauley et al. | |
| 2016/0159606 | A1 * | 6/2016 | Smith | B65H 49/32 242/533.8 |

OTHER PUBLICATIONS

Mills Fleet Farm, King Kutter Wire Unroller, http://www.fleetfarm.com, Accessed Sep. 26, 2014.

* cited by examiner

*Primary Examiner* — Sang Kim
(74) *Attorney, Agent, or Firm* — Luedeka Neely Group, P.C.

(57) ABSTRACT

A collapsible wire unroller apparatus having a frame including cradles for supporting a spindle having spools of wire. A bottom support mounted to one portion of the frame connects to a rear hitch of the all-terrain vehicle (ATV). Left and right adjustable straps mounted to another portion of the frame connect to a rear cargo rack of the ATV and reduce the weight of the spindles placed on the rear hitch.

19 Claims, 5 Drawing Sheets

HITCH-MOUNTED WIRE UNROLLER APPARATUS

FIELD

The present disclosure relates to the apparatus for unrolling and installing rolled barbed wire, and for rolling and uninstalling the wire. More particularly, the present disclosure relates to an apparatus configured to mount to a hitch of vehicle, such as an all-terrain vehicle, and to hold multiple spools of one or more varieties of wire, and to unroll each of the spools of wire separately or simultaneously as the vehicle travels.

BACKGROUND

Barbed wire is often used to provide enclosures and to mark property boundary lines. Barbed wire is typically provided on spools and is installed by unrolling and securing the wire to wood or metal posts that surround the area to be enclosed. This process is often carried out by hand and requires the spools to be lifted and the wire to be unrolled, pulled tight, and then mounted to the posts. This process is time consuming and labor intensive because it typically requires two or more workers. The task is made more difficult due to the weight of the spools as well as the often-rugged conditions where the wire is installed.

Various devices have been created to facilitate this unrolling process. Some devices were mounted to hand-drawn carts and other devices were mountable to vehicles (such as a tractor), which enable the wire to be unspooled as the vehicle moves. However, these devices are typically large and cumbersome and cannot be disassembled into smaller components for easier transport and storage when not in use. Additionally, many vehicle-mounted devices provide only a single point of connection to the vehicle, such as at the trailer hitch only, and all of the weight is borne by this single point of contact, which often leads to failure of the device at that point of contact.

What is needed, therefore, is an apparatus that can be mounted to a vehicle and have two or more mounting locations and that is configured to be at least partially disassembled for easier storage and transport.

SUMMARY OF THE INVENTION

The above and other needs are met by a hitch-mounted wire unroller apparatus that may be disassembled into smaller components and that is mounted to a vehicle in two or more locations. The unroller apparatus includes a frame for supporting one or more spools of wire and for allowing the one or more spools of wire to be wound and unwound. The frame has an interconnected top, bottom, left and right frame members forming an opening configured to receive a spool of wire. A mounting plate having connector openings is mounted to the bottom frame member. Left and right cradles, each having a top opening, are mounted to the left and right frame members. Left and right connection points are disposed on the top frame member for connecting with left and right adjustable straps. A first end of the left and right straps are optionally mounted to the left and right connection points and a second end of the left and right straps mounted to a rear cargo rack of an all-terrain vehicle (ATV). The apparatus also includes a bottom support that is removably mountable to the frame and to a rear hitch of an ATV. The bottom support has a front end, a back end, and raised left and right sides extending between the front and back end. A mounting plate is located at the back end of the bottom support, which has a plurality of connector openings configured to be mated with the mounting plate of the frame with a plurality of connectors. Two or more openings are located in the bottom support near the front end. Each of the two or more openings is configured to receive a hitch mount. The two or more openings are arranged such that the frame is selectively moved forwards or backwards as desired. The unrolling apparatus also includes a spindle configured to receive one or more spools of wire. An end of the spindle has a pair of centering members that are configured for placement on either side of one of the cradles in order to limit side-to-side movement of the spindle when placed into the cradles.

BRIEF DESCRIPTION OF THE DRAWINGS

Further advantages of the disclosure are apparent by reference to the detailed description when considered in conjunction with the figures, which are not to scale so as to more clearly show the details, wherein the reference numbers indicate like elements throughout the several views, and wherein.

DETAILED DESCRIPTION

Figure 1:
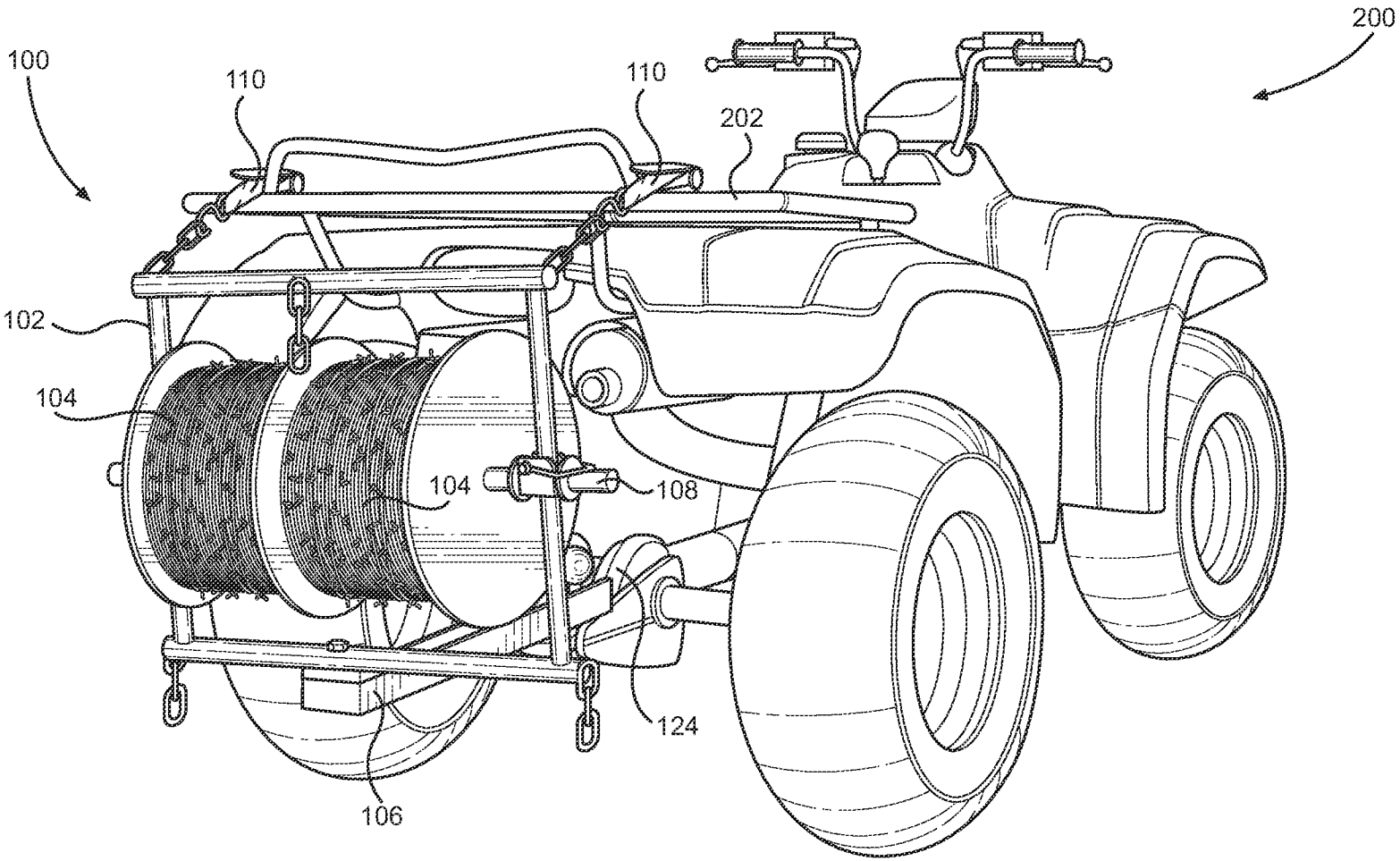
FIG. 1 is a rear perspective view of a wire unroller apparatus mounted to a receiver hitch of an all-terrain vehicle (ATV) according to an embodiment of the present invention.

Embodiments of a wire unroller apparatus of the present invention are disclosed in the following detailed description and figures. The unroller apparatus assists a user in loading, rolling, and unrolling one or more spools (or rolls) of wire quickly and easily. With initial reference to FIG. 1, an unroller apparatus 100 according to an embodiment of the present invention is shown attached to an all-terrain vehicle (ATV) 200, such as a four wheeler. The apparatus 100 generally includes a frame 102 to support one or more rolls of wire 104, a spindle 108 inserted through the rolls of wire and secured to the frame, a first support 106 mounted to the frame and secured to the ATV 200 at a first location, and a second support 110 connected to the frame and secured to the ATV at a second location.

In general, to use the unroller apparatus 100, one end of the first support 106 is mounted to a portion of the ATV 200 and then the opposite end is connected to a portion of the frame 102. In this particular instance, the first support 106 is mounted to a rear hitch of the ATV 200. The first support 106 supports the bottom of the apparatus 100 and keeps it correctly positioned during use. Next, one end of the second support 110 is connected to the frame 102 and the opposite end is connected to a second portion of the ATV. In this particular embodiment, ends of two second supports 110 are mounted at left and right sides of the frame 102 and the opposite ends are secured to a rear cargo rack 202 of the ATV 200. The second support 110 provides additional support for the apparatus and distributes weight relieving pressure on the rear hitch 124. Lastly, the spindle 108 and rolls of barbed wire 104 are secured onto a portion of the frame 102. In this particular embodiment, the spindle 108 is inserted through a center opening in the rolls of wire and is then placed into cradles which are mounted to the frame. The barbed wire is unrolled from the rolls 104 as the ATV 200 is driven. Separators (or bushings) placed between the rolls allow them to turn easily without binding on an adjacent roll of wire or on a portion of the apparatus 100, such as the frame 102.

Figure 2:
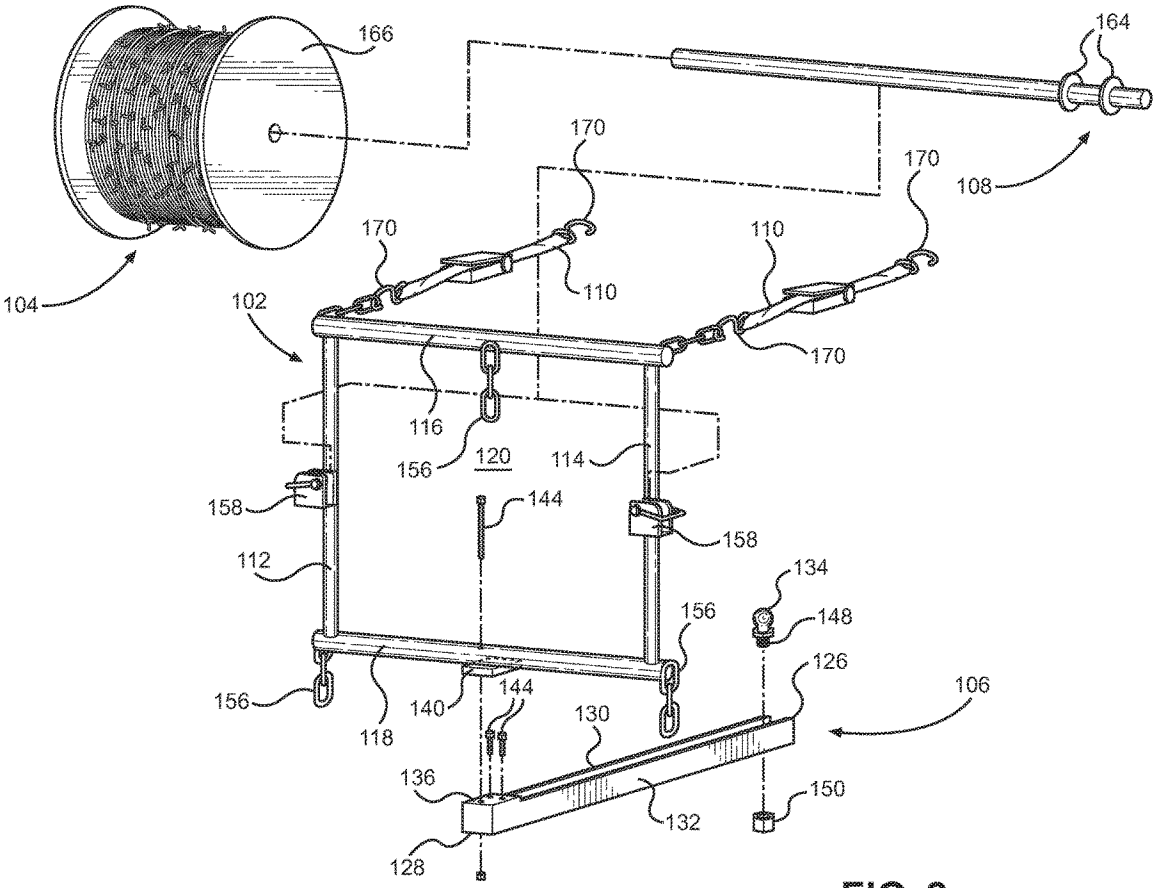
FIG. 2 is an exploded view of the wire unroller shown in FIG. 1.

An exploded view of the various components of an unroller apparatus 100 according to an embodiment of the present invention is provided in FIG. 2. In the most basic embodiment, the frame 102 includes at least a left member 112 and a right member 114 that are connected together, and the spindle 108 is removably mounted between the left and right members. In one example, the left and right members 112, 114 are provided in a V-shaped configuration and joined together along either a top or bottom end. The frame 102, spindle 108 and other components are preferably made from a material that is strong enough to support the weight of the unroller 100 itself as well as the rolls of wire 104, such as steel tubing or piping. In certain other embodiments, in addition to left and right members 112, 114, certain other embodiments may also include at least one of a top member 116 and a bottom member 118, which may be connected to the left and right members to form an enclosure having a central opening 120 therebetween that is sized and configured to receive one or more spools of wire 104.

Figure 4:
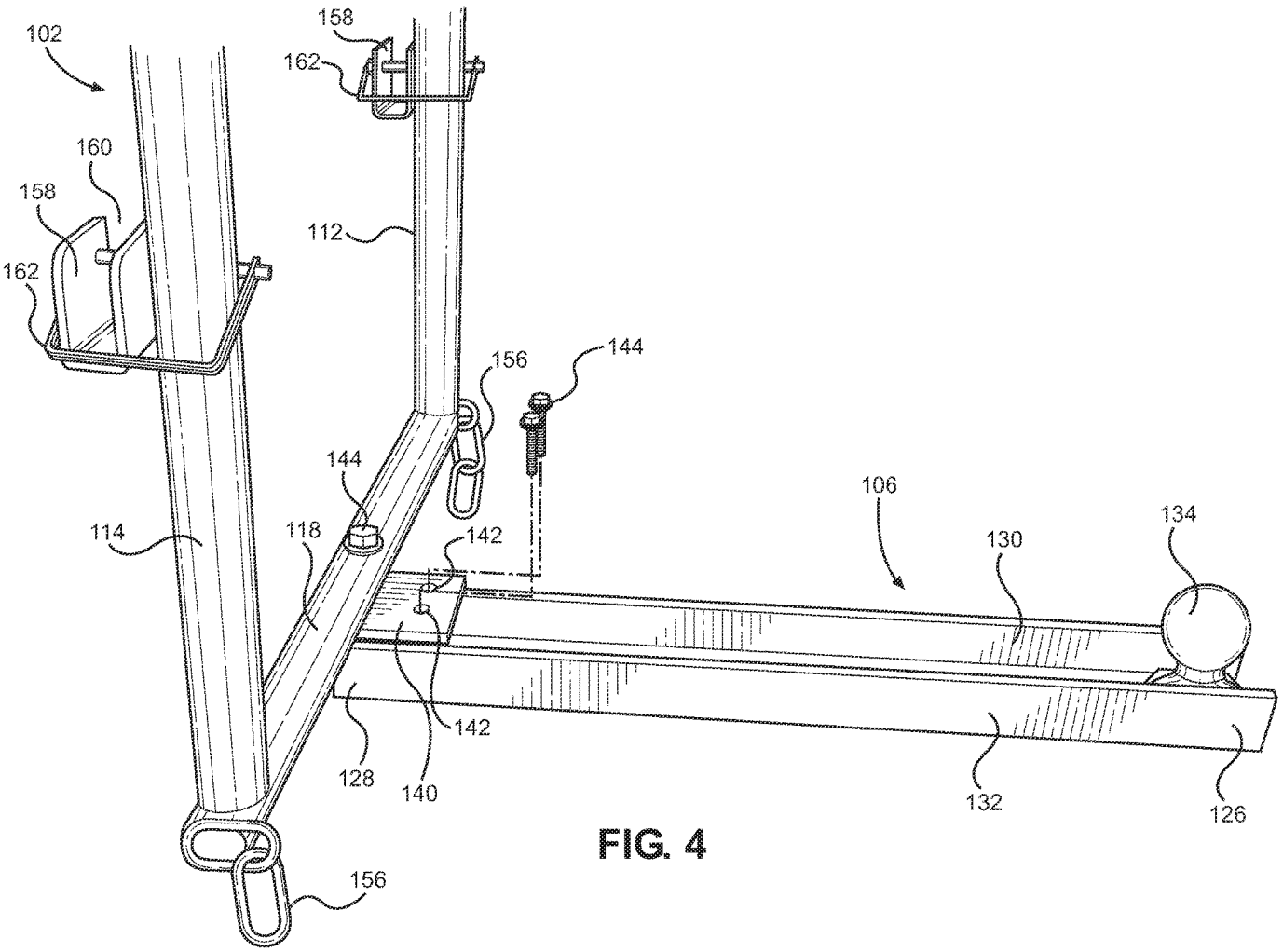
FIG. 4 is a side perspective view of a frame being mounted to the first support member with a plurality of connectors.

The frame 102 is designed to connect to and to support the spindle 108 and rolls of wire 104. Preferably, the spindle 108 is mounted between two opposing sides of the frame, such as between the left and right members 112, 114 or between the top and bottom members 116, 118. The mounting locations will determine the orientation (e.g., horizontal or vertical) of the spindle and the rolls of wire. In this particular embodiment, the spindle 108 is mounted in a horizontal configuration and is suspended between the left and right members 112, 114 of the frame 102. With reference to FIGS. 2 and 4, the left and right members 112, 114 are each provided with a cradle 158, which is generally U-shaped in this embodiment and has an upward-facing opening 160. The bar-like spindle 108 is supported by the two cradles 158 and each side is inserted into a cradle via the opening 160. To assist in preventing the spindle 108 from inadvertently being lifted or thrown from the cradle 158, such as during operation of the ATV, a retaining member 162, such as a pin or a clip, may be positioned across the opening 160 of each of the cradles. In this particular embodiment, a locking clip is shown extending through a portion of the cradle 158 and across the opening 160.

Additionally, to limit side-to-side movement of the spindle 108, centering members 164 may be provided on at least one end of the spindle. At least two centering members 164 are placed onto the spindle 108 and are spaced apart from one another such that, when the spindle is placed into the cradles 158, one centering member is positioned adjacent either side of at least one cradle. The amount of side-to-side movement of a spindle 108 equipped with centering members 164 is a function of the distance between the centering members.

Preferably, when multiple spools 104 of wire are placed onto the spindle 108, spool separators 166 are placed between adjacent spools. Additionally, spool separators 166 are placed between the outermost spools and the frame 102. For example, as shown in FIG. 1, a spool separator is located between two adjacent spools of barbed wire on the spindle 108 and also between the spool 104 and the left and right vertical members 112, 114. Use of spool separators 166 in this manner assists in preventing the rotating spools 104 from contacting and/or binding with other adjacent spools or with the wire unroller apparatus 100 itself. Additionally, providing spool separators 166 assists in preventing accidental contact between objects or bystanders and the spool of wire as the spools are rotated.

Preferably, the spool separators 166 are disc- or doughnut-shaped, having a central opening that allows the separator to be inserted over the spindle 108. The spool separators 166 may be provided in a range of sizes having differing diameters. Preferably, the spool separators 166 have an outer diameter that is at least equal to or greater than the outer diameter of each spool of wire on the spindle such that the wire never extends beyond the outer edge of the spool separator. This size selection step is important to assist in preventing accidental contact with the wire spool as it rotates about the spindle. The spool separator 166 may be constructed from any generally rigid material that is able to withstand wear caused by contact with the wire spools and to maintain a suitable useful life. An example of a suitable material is steel.

The frame 102 is designed to mount to an ATV 200 in at least two locations. This provides for a more secure, stable connection. Another benefit of having at least two points of connection to the ATV 200 is that the forces present in each of those mounting locations can be dramatically reduced, which is particularly important when the apparatus is weighted with one or more rolls of wire. Reducing the weight on the hitch is particularly beneficial because these are prone to breaking when overloaded. Dividing the combined weight of the apparatus and wire between at least two connection points allows a heavier load to be carried with a reduced risk of breaking the hitch.

Figure 3:
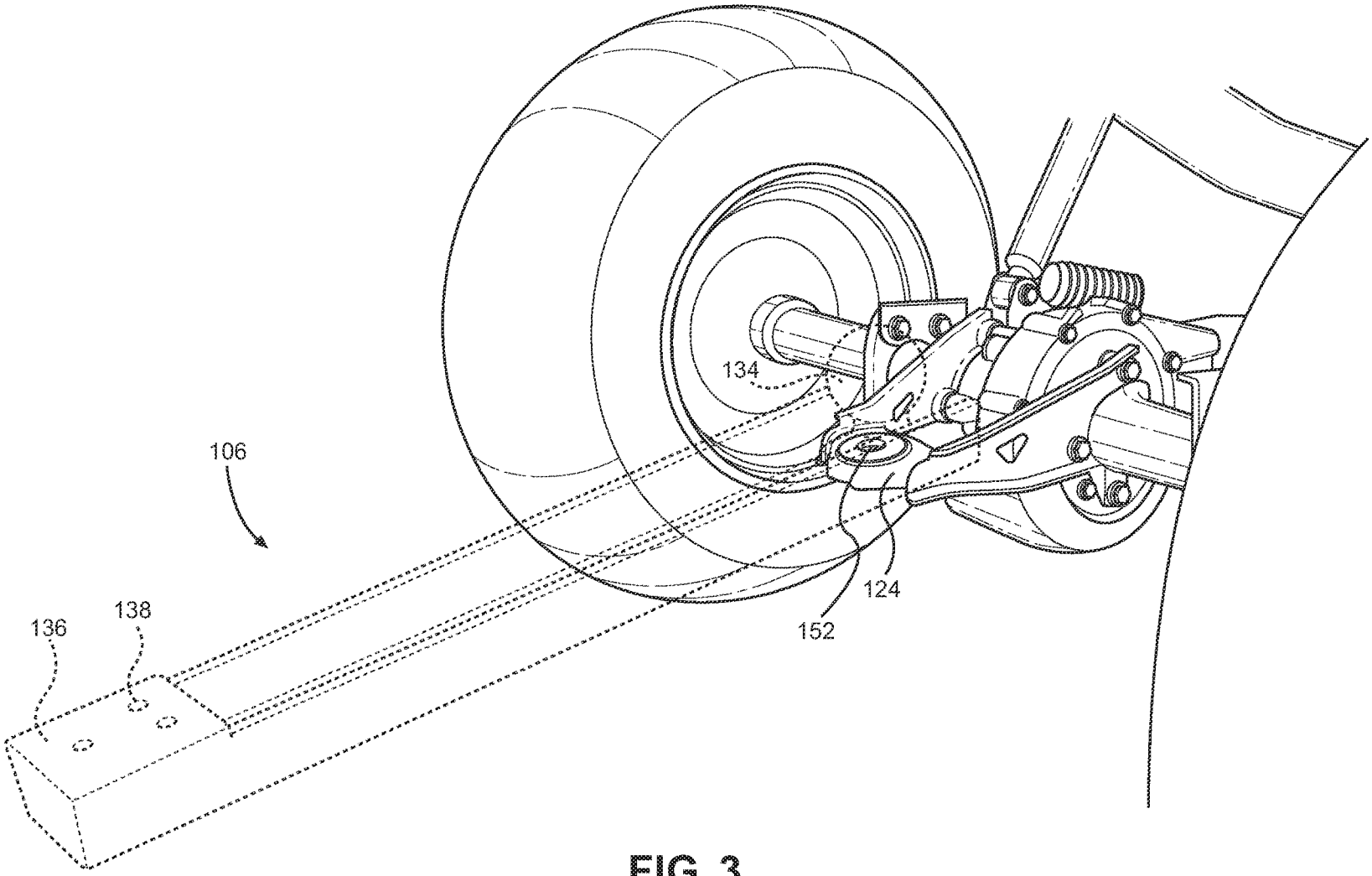
FIG. 3 is illustrates a first support member mounted to a rear hitch of an ATV.

With reference to FIGS. 2-4, the first support 106 provides the first connection between the frame 102 and the ATV 200. The first support 106 is configured to be removably mounted to the frame 102 and is also configured to removably mount to a rear hitch 124 of the ATV 200. The first support 106 includes a front end 126, a back end 128, and raised left and right sides 130, 132 that extend upwards away from the top surface of the support between the front and back ends to form a channel-like area on the top surface of the first support 106. The channel area located between the left and right sides 130, 132 is sized to receive a hitch mount 134. Additional details of this channel area are provided in a later discussion below. The first support 106 also includes a mounting plate 136 having a number of connector openings 138. The mounting plate 136 is provided at the back end 128 of the first support 106 and is used to mount the first support 106 to the frame 102. A corresponding mounting plate 140 having a number of connector openings 142 (shown best in FIG. 4) is mounted to the bottom portion of the frame 102. The mounting plates 136, 140 may be mated together by inserting connectors 144 through both of the connector openings and fixing them therein. The connector openings 138 may include threaded bores and be configured to receive a threaded connector 144. Alternatively, the connector openings may be unthreaded and a nut and bolt or other similar connector 144 could be utilized.

Figure 5:
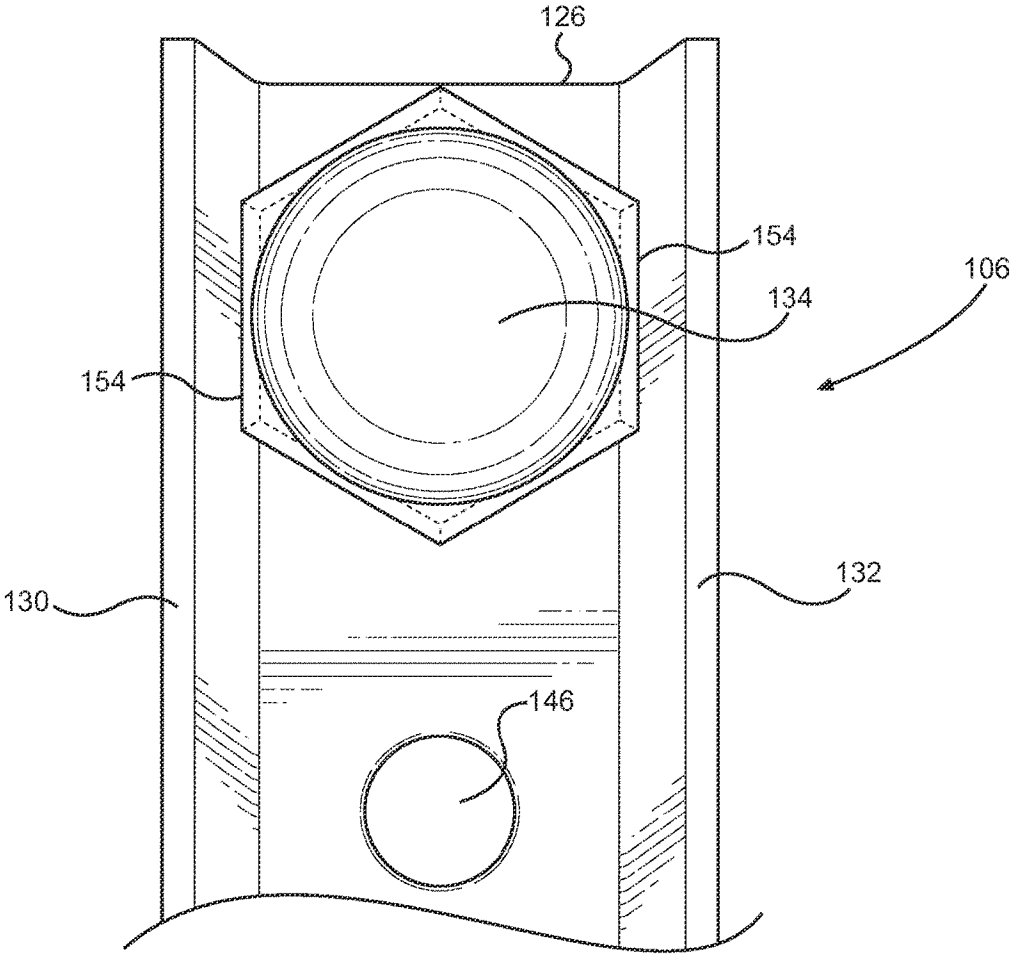
FIG. 5 is a top view of the first support member having multiple openings for receiving a hitch mount.

With reference to FIGS. 2, 3 and 5, the front end 126 of the first support 106 includes one or more hitch mount openings 146 that receive the hitch mount 134 and enable it to be mounted to the rear hitch of the ATV. The hitch mount 134 may include a threaded bolt portion 148 and a corresponding nut 150 that may be threaded onto the bolt portion.

The bolt portion 148 may be inserted into one of the hitch mount openings 146, through an opening 152 in the rear hitch 124, and then secured by threading the nut 150 over the bolt portion. In certain embodiments, two or more hitch mount openings 146 are provided between the front end 126 and the back end 128 so that the apparatus 100 may be repositioned in a more forward or rearward direction as desired.

Additionally, it may be desirable to limit the rotation of the first support 106 with respect to the ATV 200. Accordingly, the hitch mount 134 may be provided with two or more opposed flats 154 that are configured to contact the left and right raised sides 130, 132 after the hitch mount 134 has been inserted into the channel portion of the first support 106. Ideally, the left and right raised sides 130, 132 are spaced far enough apart that the hitch mount 134 may be easily inserted into the channel area during installation, but near enough that the flats 154 can make contact with the sides and limit the rotation of the first support 106 if there is movement during operation of the apparatus 100. As discussed below, while side-to-side movement is limited, the back end 128 of the first support 106 is able to rotate somewhat freely in an upwards and downwards direction, with the connection between the front end 126 and the hitch 124 serving as the center of rotation.

With reference to FIG. 2, the second support 110 provides the second connection between the frame 102 and the ATV 200. As mentioned previously, the primary purposes of this second connection point are to provide additional support and to reduce the forces placed on the hitch 124 and hitch mount 134 due to the weight of the apparatus itself and the rolls of wire. The second support 110 may comprise a rigid bar similar to the first support 106, which could be mounted between a portion of the frame 102 and the ATV 200. However, in a preferred embodiment, the second support comprises a length adjustable strap.

After the frame 102 has been mounted to the ATV 200 via the first support 106 in the manner discussed above, the second support 110 is then used to provide a second connection between the frame 102 and ATV 200. In particular, the frame 102 may be provided with one or more connection points 156 where ends of the adjustable strap may be connected. In this particular embodiment, the frame 102 is provided with five connection points 156 disposed around the perimeter of the frame, including on the top and bottom members 116, 118. The connection points 156 consist of small sections of chain which have been welded to the frame 102. The adjustable strap includes hook ends 170 that are linked with the chain links. The opposite ends of the adjustable strap may also include hook ends 170 that may be used to connect the strap to a portion of the ATV 200, such as the rear cargo rack 202 or to the axle of the ATV.

First, the straps are pre-tensioned, the rolls of wire 104 are then placed onto the spindle 108, and the spindle is then positioned in the cradles 158 and secured by the retaining members 162. Next, a final tension is provided by tightening the length-adjustable strap in order to prepare the unrolling apparatus for use. Tightening the strap causes the frame 102 to rotate about the hitch 124 in an upward direction and towards the rear cargo rack 202. Tightening the straps places them into tension and a portion of the weight of the frame 102 and rolls of wire 104 are borne by the rear cargo rack 202 of the ATV 200. This removes a portion of the weight placed on the hitch 124 and reduces the chances that the hitch will fail.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. A wire unroller apparatus for use with a vehicle comprising:

a frame having a vertically-oriented central opening;

a first support having a first end configured to detachably connect substantially horizontally to a first portion of the frame and a second end configured to connect to a first portion of a vehicle;

a second support having a first end configured to detachably connect to a second portion of the frame and a second end configured to a second portion of the vehicle; and a spindle mountable to the frame and configured to hold a spool of wire.

2. The unroller apparatus of claim 1 wherein the frame comprises left and right support members and wherein the spindle is mounted within the central opening between the left and right support members.

3. The unroller apparatus of claim 2, wherein the cradles are mounted to each of the left and right support members, each cradle having an opening configured to receive and support the opposing ends of the spindle.

4. The unroller apparatus of claim 3 further comprising a retaining member associated with each cradle, the retaining member selectively engageable to cover the openings of the cradles and secure the spindle in the cradles.

5. The unroller apparatus of claim 2 further comprising top and bottom support members connected to the left and right support members, wherein the central opening is defined by the left and right support members and the top and bottom support member and the central opening being configured to receive a spool of wire.

6. The unroller apparatus of claim 5 comprising left and right connection members disposed on the top support member, each connection member configured to mount to a first end of the second support.

7. The unroller apparatus of claim 5 further comprising a mounting plate having a plurality of connector openings mounted to the bottom support member and a corresponding mounting plate disposed at the first end of the first support, the corresponding mounting plate having a plurality of connector openings configured to be mated with the mounting plate with a plurality of connectors.

8. The unroller apparatus of claim 1, wherein the first support includes two or more openings that are spaced apart from one another and are aligned between the first and second ends of the first support, each of the two or more openings configured to receive a hitch mount and arranged such that the frame is moveable forwards or rearwards and wherein the positioning is determined by which of the openings the hitch mount is received in.

9. The unroller apparatus of claim 1 wherein the spindle is configured to hold two or more spools of wire.

10. The unroller apparatus of claim 1 further comprising two or more separators having a central opening configured to receive the spindle, the separators configured for placement adjacent either side of the spool of wire.

11. The unroller apparatus of claim 1 wherein the second end of the second support is configured to removably mount to a rear cargo rack of an ATV and the second end of the first support is configured to removably mount to a lower hitch mount of the ATV.

12. The unroller apparatus of claim 1 wherein the second end of the first support is configured to removably mount to a rear hitch of an ATV with a hitch mount.

13. The unroller apparatus of claim 12 wherein the first support includes a front end, a back end, and raised left and right sides extending between the front and back end, and wherein the hitch mount includes two or more opposed flats that are configured to contact the left and right raised sides and wherein the left and right raised sides are spaced apart such that the flats contact the sides and the first support is prevented from turning.

14. The unroller apparatus of claim 1 wherein the second support comprises an adjustable strap operable to apply tension to a portion of the frame.

15. A collapsible hitch-mounted wire unroller apparatus comprising:

a frame for supporting one or more spools of wire and for allowing the one or more spools of wire to be spooled and unspooled, the frame having:

interconnected top, bottom, left and right frame members forming an opening configured to receive a spool of wire;

a mounting plate having connector openings, the plate mounted to the bottom frame member;

left and right cradles, each having a top opening, mounted to the left and right frame members;

left and right connection points disposed on the top frame member;

a bottom support removably mountable to the frame and configured to removably mount to a rear hitch of an ATV, the bottom support having;

a front end, a back end, and raised left and right sides extending between the front and back end;

a mounting plate located at the back end having a plurality of connector openings configured to be mated with the mounting plate of the frame with a plurality of connectors;

two or more openings disposed in the bottom support proximate the front end, each of the two or more openings configured to receive a hitch mount and arranged such that the frame may be selectively moved forwards or backwards;

a spindle configured to receive one or more spools of wire, an end of the spindle including a pair of centering members configured for placement on either side of one of the cradles to limit side-to-side movement of the spindle when placed into the cradles; and left and right adjustable straps, a first end of the left and right straps mounted to the left and right connection points and a second end of the left and right straps mounted to a rear cargo rack of the ATV.

16. The unroller apparatus of claim 15 wherein the spindle is configured to rotatably mount two or more spools of wire.

17. The unroller apparatus of claim 15 further comprising two or more separators having a central opening configured to receive the spindle, the separators configured for placement adjacent either side of the spool of wire.

18. The unroller apparatus of claim 15 further comprising retaining members configured to prevent the spindle from being lifted out of the cradles.

19. The unroller apparatus of claim 15 wherein the hitch mount includes two or more opposed flat side surfaces that are configured to contact the left and right raised sides of the bottom support and wherein the left and right raised sides are spaced apart such that the hitch mount is prevented from turning.

* * * * *